United States Patent [19]

Endo et al.

[11] Patent Number: 4,789,878

[45] Date of Patent: Dec. 6, 1988

[54] ELECTROPHOTOGRAPHIC APPARATUS

[75] Inventors: Makoto Endo, Tokyo; Yoshihiro Saito, Hachiohji, both of Japan

[73] Assignee: Canon Kabushiki Kaisha, Tokyo, Japan

[21] Appl. No.: 47,572

[22] Filed: May 8, 1987

Related U.S. Application Data

[63] Continuation of Ser. No. 716,808, Mar. 27, 1985, abandoned.

[30] Foreign Application Priority Data

| | | | |
|---|---|---|---|
| Mar. 4, 1984 | [JP] | Japan | 59-66500 |
| Mar. 4, 1984 | [JP] | Japan | 59-66501 |
| Mar. 4, 1984 | [JP] | Japan | 59-66502 |
| Mar. 4, 1984 | [JP] | Japan | 59-66503 |
| Apr. 3, 1984 | [JP] | Japan | 59-66504 |

[51] Int. Cl.[4] ..... G03G 15/08

[52] U.S. Cl. ..... 355/14 D; 355/3 DD

[58] Field of Search ..... 355/3 R, 3 DD, 14 D, 355/14 E, 14 CH

[56] References Cited

U.S. PATENT DOCUMENTS

| | | | |
|---|---|---|---|
| 2,890,968 | 6/1959 | Giaimo | 355/4 X |
| 3,877,803 | 4/1975 | Seliger | 355/3 R |
| 4,035,069 | 7/1977 | Yano | 355/14 D X |
| 4,087,171 | 5/1978 | Yano | 355/14 D |
| 4,176,942 | 12/1979 | Tatsumi et al. | 355/14 R |
| 4,256,401 | 3/1981 | Fujimura et al. | 355/14 D X |
| 4,341,463 | 7/1982 | Kashiwagi et al. | 355/14 CH |
| 4,500,195 | 2/1985 | Hosono | 355/3 |
| 4,529,293 | 7/1985 | van Vlimmeren | 355/14 D |
| 4,600,294 | 7/1986 | Suzuki et al. | 355/14 D |
| 4,627,703 | 12/1986 | Suzuki et al. | 355/3 |
| 4,678,314 | 7/1987 | Uchida et al. | 355/5 |

*Primary Examiner*—Fred L. Braun

*Attorney, Agent, or Firm*—Fitzpatrick, Cella, Harper & Scinto

[57] ABSTRACT

A electrophotographic apparatus capable of operating both in a mode for obtaining a positive image from a negative original and in a mode for obtaining a positive image from a positive original and capable of constantly controlling the image density in either mode. The apparatus can be used selectively in either mode, and in both modes the image density can be controlled by a common operating member.

18 Claims, 10 Drawing Sheets

ELECTROPHOTOGRAPHIC APPARATUS

This application is a continuation of application Ser. No. 716,808 filed Mar. 27, 1985, now abandoned.

BACKGROUND OF THE INVENTION

1. Field of the Invention

The present invention relates to an electrophotographic apparatus, and more particularly to such an apparatus capable of regulating the image density.

2. Description of the Prior Art

In a microfilming apparatus or a microfilm reader-printer, the original image stored on a microfilm may be positive or negative. In either case the copy to be prepared from such original should be positive. In order to meet such requirement there is already known an electrophotographic apparatus which can be switched between a mode for forming a positive image from a negative original image (N-P mode) and another mode for forming a positive image from a positive original image (P-P mode).

In the following there will be explained the image formation in the N-P mode and in the P-P mode, in an electrophotographic apparatus shown in FIG. 1. In case of N-P mode, a drum-shaped photosensitive or image bearing member 1, having a photoconductive layer on a conductive member, is at first negatively charged by a primary charger 2 in a dark place and is exposed to a light from a negative original to form a negative electrostatic latent image. Said electrostatic latent image is subjected to a reversal development with negatively charged toner supplied from a developing unit 4. A bias voltage HAC composed of an AC voltage superposed with a negative DC voltage is applied to a developing sleeve 4*a* and a blade 4*b* whereby the negatively charged toner jumps to an exposed light area of a surface potential of about 0V thus achieving image development. The image composed of the negatively charged toner is then transferred onto a transfer sheet P by the application of a positive corona discharge by a transfer charger 5 from the rear side of said transfer sheet P. In the image formation in P-P mode, there is employed a developing unit 4 capable of supplying positively charged toner. The photosensitive member 1 negatively charged is exposed to the light 3 of a positive original to form a positive electrostatic latent image, which is directly developed with the positively charged toner. Said toner supplied from the developing unit 4 receiving the bias voltage HAC is deposited in the unexposed dark area of a negative surface potential on the photosensitive member 1. The image composed of the positively charged toner is transferred onto the transfer sheet P with a negative corona discharge of the transfer charger 5. Both in the N-P and P-P modes, a hard copy is obtained by fixing the image on the transfer sheet P. On the other hand, after image transfer, the toner remaining on the photosensitive member 1 is cleaned by a cleaning unit 6 and the retentive charge is dissipated by a uniform illumination 7. In this manner a next image forming cycle can be initiated. There are also shown a photoelectric sensor 8 for detecting the transfer sheet P, a slit 9 and a shutter 10.

In such an electrophotographic apparatus, the density of the obtained copy image is regulated by controlling the DC component, which will hereinafter be called developing bias voltage, of the biased AC voltage HAC applied to the developing sleeve 4*a*. As will be understood from FIG. 2, a higher developing bias voltage provides a higher density in the N-P mode but a lower density in the P-P mode. Conventionally, the developing bias voltage is regulated by a variable resistor linked with a density control knob, and an erroneous operation is apt to occur since the direction of control is inverted in the N-P and P- modes. Although there may be employed separate density control knobs and variable resistors respectively for the N-P and P-P modes, such method requires complicated operation because of the increased operating parts and does not necessarily prevent the error in operation. It may also result in an increased cost because of an increased number of parts.

In addition, the regulating range of the developing bias voltage for obtaining an adequate image density is not the same in both modes. Consequently, a single variable resistor, if employed for regulating the developing bias voltage, will provide the same regulating range for both modes and will therefore be unable to cover the optimum image density ranges in both modes.

Furthermore, in the N-P mode the operating positive voltage of the charger 5 is made higher for improving the efficiency of image transfer, and such higher positive voltage shifts the surface potential of the photosensitive member 1 to positive, contrary to the charging characteristic thereof. Consequently, the retentive charge cannot be sufficiently eliminated unless the illumination for charge elimination is made considerably strong. Particularly in a space between the transfer sheets P, positive corona ions directly reach the photosensitive member 1 to generate a higher potential than in an area subjected to the corona discharge through the transfer sheet P. Experimentally a voltage of the transfer charger, that will generate a potential of +80V, by corona discharge through the transfer sheet, on the photosensitive member showing a surface potential of −800V after primary charging, generates a potential of +500V by direct corona discharge without the transfer sheet. The retentive charge of such magnitude gives rise to an uneven charge elimination even if the illumination 7 is made strong. A primary charging in the next imaging cycle, if applied after such uneven charge elimination, will result in uneven surface potential. The peripheral length of the photosensitive member 1 is often shorter than the length of the transfer sheet P, so that a copying cycle often requires two or several turns of the photosensitive member 1. In the second and ensuing turns the photosensitive member 1 has already been subjected to the transfer corona discharge, so that the image formation in a copy is conducted with different states of primary charging, thus resulting in uneven image density.

On the other hand, in the P-P mode, a nonimage area not subjected to imagewise exposure is developed black because of the presence of a charge, thus giving an unpleasant black frame adjacent to image area, and also wasting the toner. In order to avoid such unnecessary development, a uniform illumination, called blank exposure, is conventionally given to the non-image area, but such blank exposure tends to generate a background smudge or a black streak at the beginning or at the end of image exposure on the photosensitive member.

SUMMARY OF THE INVENTION

In consideration of the foregoing, an object of the present invention is to provide an electrophotographic apparatus not associated with the above-mentioned drawbacks.

Another object of the present invention is to provide an electrophotographic apparatus capable of operating both in the N-P mode and in the P-P mode and regulating the image density in either mode in a simple and unmistakable manner.

Still another object of the present invention is to provide an electrophotographic apparatus allowing adequate adjustment of the image density in either mode.

Still another object of the present invention is to provide an electrophotographic apparatus capable of providing an image of uniform density in the N-P mode.

Still another object of the present invention is to provide an electrophotographic apparatus capable of providing an image of a high quality in the P-P mode, reducing the consumption of toner and avoiding the damage in the image bearing member by spark discharge.

DETAILED DESCRIPTION OF THE PREFERRED EMBODIMENTS

Now the present invention will be clarified in detail by embodiments thereof shown in the attached drawings.

Figure 3:
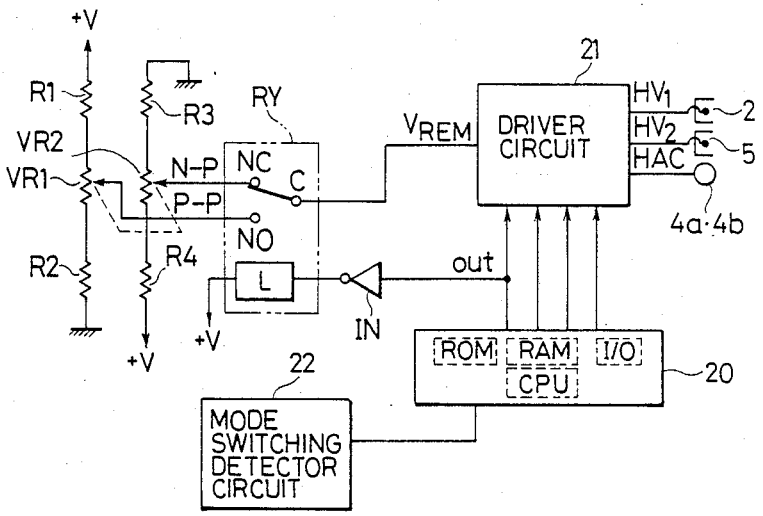
FIG. 3 is a circuit diagram of an image density regulating device embodying the present invention.
Figure 4:
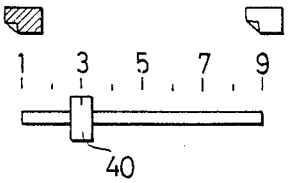
FIG. 4 is a schematic view of a density scale and a control knob.

FIG. 3 is a block diagram showing an image density regulating device embodying the present invention and including a microcomputer 20 comprising a central processing unit CPU, memories ROM, RAM, input-/output port I/O etc. on a semiconductor chip; a driving circuit 21 for supplying chargers 2, 5, a developing sleeve 4*a* and a blade 4*b* with driving voltages V1, HV2, HAC under the control of said microcomputer 20; a mode switching detection circuit 22 for supplying the microcomputer 20 with a mode switching signal corresponding to the N-P and P-P modes; and a circuit composed of an inverter IN, linked variable resistors VR1, VR2 and fixed resistors R1–R4 to be controlled by an output signal OUT of the microcomputer 20 for supplying a developing bias remote signal $V_{REM}$ to the driving circuit 21. When a normally open contact NO is in contact with a common terminal C by the energization of a control coil L of a relay RY, a fixed voltage +V is divided by the resistor R1, variable resistor VR1 and resistor R2 to provide said remote signal $V_{REM}$. On the other hand, when the relay RY is deactivated to turn on the normally closed contact NC, the remote signal $V_{REM}$ is given by dividing the voltage +V with the resistor R4, variable resistor VR2 and resistor R3.

In the P-P mode, the voltage range of the remote signal $V_{REM}$ is determined by the ratio of the resistor R1 to the resistor R2. On the other hand, in the N-P mode, said range is determined by the ratio of the resistor R3 to the resistor R4.

Figure 10:
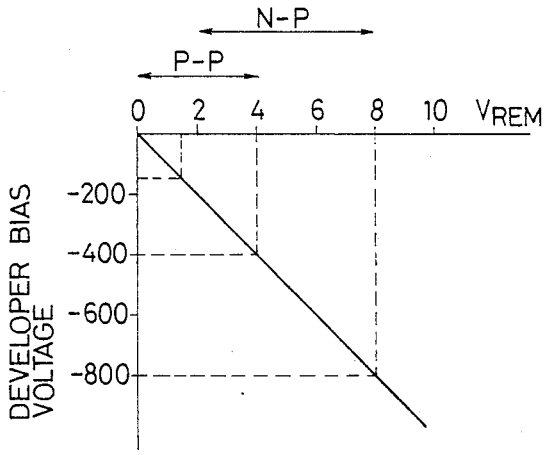
FIG. 10 is a chart showing the relationship between a remote signal voltage and the developing bias voltage.

FIG. 10 shows the relationship between the remote signal $V_{REM}$ and the developing bias voltage. In an electrophotographic apparatus such as a microfilm printer, the variable range of the developing bias voltage for obtaining optimum image density in the N-P mode is usually from −150 to −800V. 0n the other hand, said range in the P-P mode is from 0 to −400V. Consequently, the remote signal $V_{REM}$ correspondingly has a variable range of 1.5 to 8V in the N-P mode and a variable range of 0 to 4V in the P-P mode. The values of the variable resistors VR1, VR2 and resistors R1–R4 are determined to cover the above-mentioned ranges in consideration of the fixed voltage +V.

Figure 5:
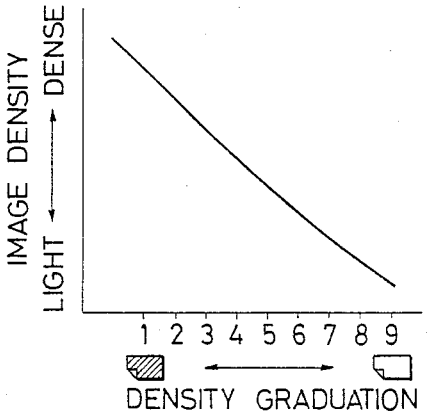
FIG. 5 is a chart showing the change in density as a function of the density scale.

Linked variable resistors VR1, VR2 are for example of the slider type and are linked to a common control knob 40 shown in FIG. 5, laterally slidable along a density scale on an operation panel of the electrophotographic apparatus. Consequently, in the P-P mode, a movement of the knob 40 from "1" (higher density) to "9" on the density scale causes an increase, in a low range, of the remote signal $V_{REM}$ released from the variable resistor VR1 through the normally open contact NO and common terminal C. On the other hand, in the N-P mode, there is caused a decrease, in a relatively high range, of the remote signal $V_{REM}$ released from the variable, resistor VR2 through the normally closed contact NC and common terminal C.

Figure 6:
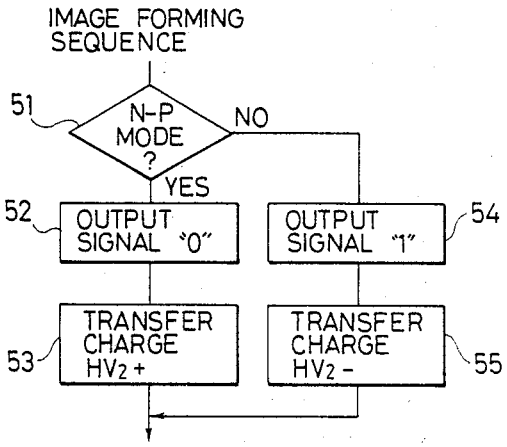
FIG. 6 is a flow chart of the function of the density regulating device.

The microcomputer 20 functions according to a program stored in a ROM area thereof. FIG. 6 shows a flow chart for executing the program representing the present invention in the image forming sequence. In the following, the function will be explained in relation to said flow chart. At first a negative hig voltage HV1 is supplied to negatively charge the photosensitive member 1, and the shutter 10 is opened for imagewise exposure for forming an electrostatic latent image. A step 51 in the flow chart discriminates the N-P mode or the P-P mode by the output signal of the mode switching detection circuit 22. In case of the N-P mode, the output signal OUT is shifted to "0" in a step 52. Since the inverter IN releases an output signal "1" in this state, the normally closed contact NC of the relay RY is in contact with the common terminal C, thereby enabling the regulation with the variable resistor VR2. The remote signal $V_{REM}$ in this state decreases by the displacement of the density control knob 40 from "1" to "9", whereby the developing bias voltage is decreased to lower the image density. In a step 53 the driver circuit 21 receives an instruction to shift the voltage HV2 to the transfer charger 5 to positive. On the other hand, in case the P-P mode is identified in the step 51, the output signal OUT is shifted to "1" in a step 54. In this state the inverter IN releases a signal "0" so that the normally open contact NO of the relay RY is in contact with the common terminal C, thereby enabling the regulation with the variable resistor VR2. In this state the remote signal $V_{REM}$ increases with the displacement of the knob 40 from "1" to "9", whereby the developing bias voltage becomes lower to reduce the image density. A step 55 supplies the driver circuit 21 with an instruction to shift the voltage HV2 to the transfer charger 5 to negative. The program returns to the usual image forming sequence after the step 53 or 55.

In this manner, as shown in FIG. 5, the indication on the density scale always corresponds to the image density both in the N-P and P-P modes.

Figure 7:
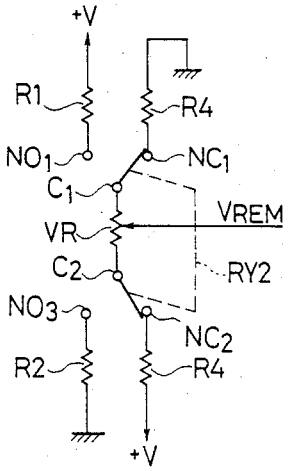
FIGS. 7 to 9 are circuit diagrams showing another embodiment the regulating device.

FIG. 7 shows another embodiment of the circuit portion generating the remote signal $V_{REM}$, in the circuit shown in FIG. 3, wherein a relay RY2 controlled by the output signal OUT of the microcomputer 20 has two pairs of contacts, while a single variable resistor VR is employed for regulation and connected to the control knob 40. In the illustrated state for the N-P mode, normally close contacts NC1, NC2 of the relay RY2 are respectively in contact with common terminals C1, C2 whereby the remote signal $V_{REM}$ is obtained by dividing the fixed voltage +V with the resistor R4, variable resistor VR and resistor R3. In the P-P mode, normally open contacts NO1, NO2 are respectively in contact with the common terminals C1, C2 whereby the fixed voltage +V is divided by the resistor R1, variable resistor VR and resistor R2. Thus a movement of the variable resistor VR in the same direction can cause mutually opposite changes in the remote signal $V_{REM}$ according to the operating mode.

Figure 8:
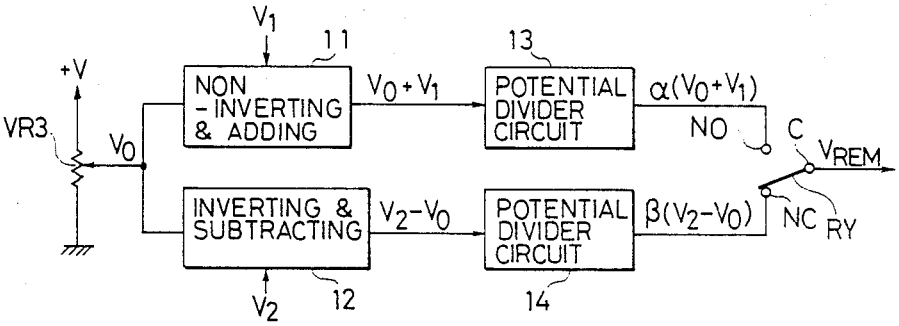

FIG. 8 shows another embodiment of the circuit portion for generating the remote signal $V_{REM}$. This embodiment utilizes logic elements such as operational amplifiers and is composed of a combination of addition-subtraction circuits, multiplicationdivision circuits, inverted and non-inverted amplifying circuits. A voltage $V_0$ obtained by dividing the fixed voltage +V with a variable resistor VR3 linked to the control knob 40 is supplied to a non-inverted adding circuit 11 and is added with a fixed voltage $v_1$ to obtain $v_{0+v1}$. The obtained voltage is supplied to a voltage dividing circuit 13 to obtain a voltage $V_{REM}=\alpha(v_0+v_1)$ wherein $0<\alpha\leqq 1$. On the other hand, voltage $v_0$ is supplied to an inverted subtracting circuit 12 for subtraction of a fixed voltage $v_2$ simultaneous with inverted amplification to obtain $v_2-v_0$. The obtained voltage is supplied to a $V_{REM}=\beta(v_2-v_0)$ wherein $0<\beta\leqq 1$. These two output voltages $\alpha(v_0+v_1)$ and $\beta(v_2-v_0)$ are released as the remote signal $V_{REM}$ respectively through the contacts NO, NC of the relay RY.

Figure 1:
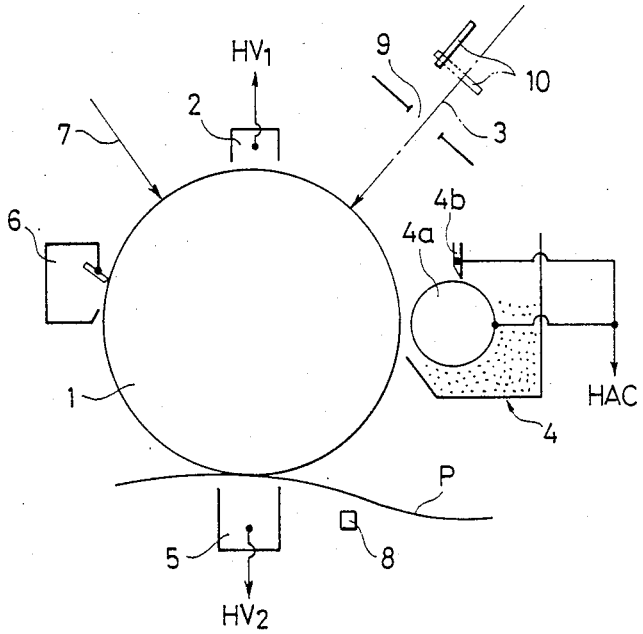
FIG. 1 is a schematic view of an electrophotographic apparatus embodying the present invention.
Figure 2:
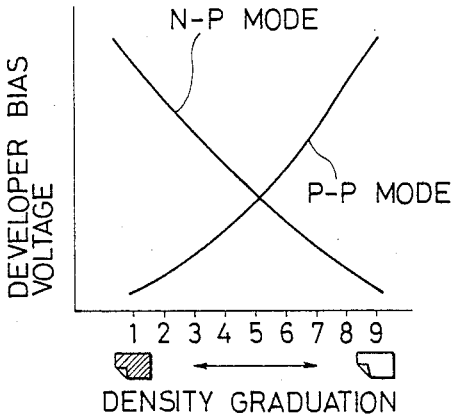
FIG. 2 is a chart showing the relationship between a image density scale and the developing bias voltage.
Figure 9:
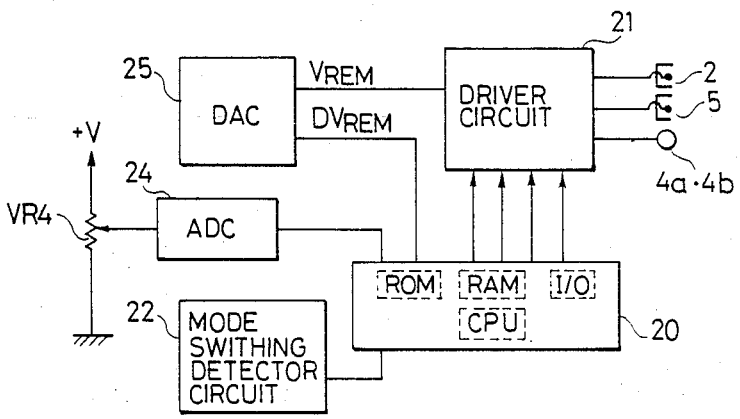

FIG. 9 shows another embodiment of the regulating device, wherein a divided output voltage of a variable resistor VR4 linked with the control knob 40 is supplied to the microcomputer 20 after conversion into a digital signal by an A/D converter 24. The ROM of the microcomputer 20 stores a program which is activated by a signal from the mode switching detection circuit 22 and generates a digital signal $DV_{REM}$ for varying the developing bias voltage as shown in FIG. 2. Said digital signal $DV_{REM}$ is supplied to the driving circuit 21 after conversion into an analog signal in a D/A converter 25. In this case, a non-linear relation in the chart shown in FIG. 2 can be easily compensated by modifying the content of the ROM data. It is therefore unnecessary to use conventional adjustment by hardware, for example with an intermediate tap of the variable resistor. Also the range of the output signal can be easily modified.

As explained in the foregoing, the electrographic apparatus of the present invention provided with the image density regulating device allows to regulate the image density in different image forming modes with a single control knob and a scale, thus simplifying the operation and preventing the errors in the operation.

Figure 11:
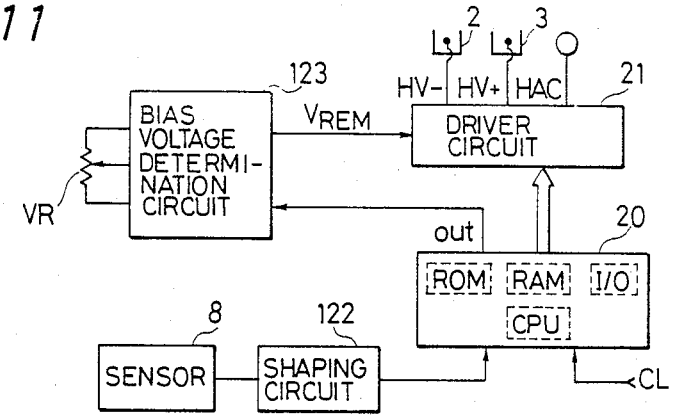
FIG. 11 is a block diagram showing another embodiment of an image density regulating device according to the present invention.

FIG. 11 is a block diagram of another embodiment of the image density regulating device applicable in the N-P mode, wherein the same components as those in the foregoing embodiments are represented by the same numbers. In FIG. 11, there are shown a microcomputer 20 composed of a central processing unit ( CPU, memories ROM, RAM, and an input/output port I/O etc. formed on a semiconductor chip; a driving circuit 21 for supplying the chargers 2, 5, developing sleeve 4a and blade 4b with driving voltages HV−, HV+ and HAC under the control by said microcomputer 20, a wave form shaping circuit 122 for supplying the microcomputer 20 with, after wave form shaping, an output signal of the photoelectric sensor 8 for detecting the transfer sheet P; and a voltage determining circuit 123 for regulating the biased AC voltage (developing bias voltage) with a variable resistor VR to supply the obtained remote signal $V_{REM}$ to the driving circuit 21. The density of the developed image can be arbitrarily regulated by said variable resistor VR.

Figure 12:
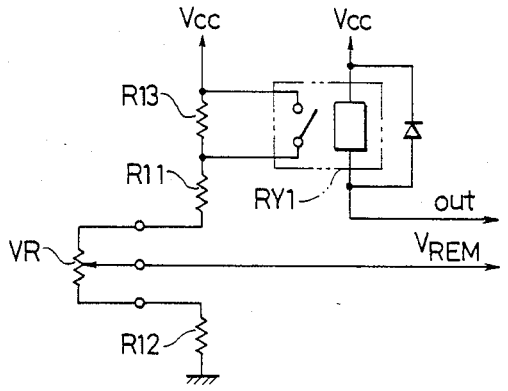
FIG. 12 is a circuit diagram showing an essential part thereof.

FIG. 12 shows the details of said bias voltage determining circuit 123, in which, when a relay RY1 is energized, the remote signal $V_{REM}$ is obtained by dividing a fixed voltage Vcc with resistor R11, variable resistor VR and resistor R12. On the other hand, when the relay RY1 is deactivated, the remote signal $V_{REM}$ is obtained by dividing the fixed voltage Vcc with resistors R13 and R11, variable resistor VR and resistor R12. Consequently for a given position of the variable resistor VR, the remote signal $V_{REM}$ becomes lower when the relay RY1 is deactivated, and the amount of such lowering depends on the ratio of voltage division of the variable resistor VR. Thus the extent of lowering is large or small respectively when the remote signal voltage $V_{REM}$ is high or low.

Figure 13:
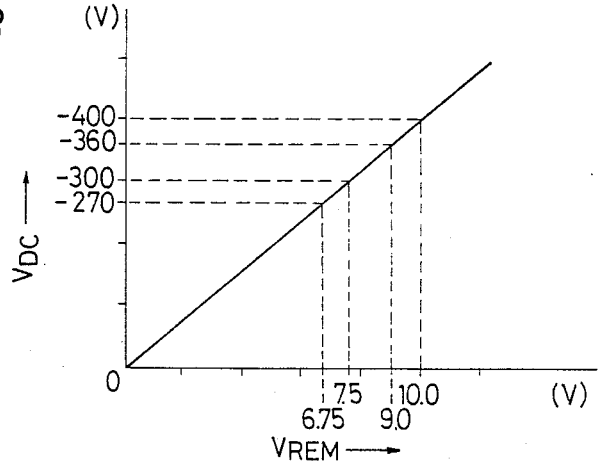
FIG. 13 is a chart showing the change in the developing bias.
Figure 14:
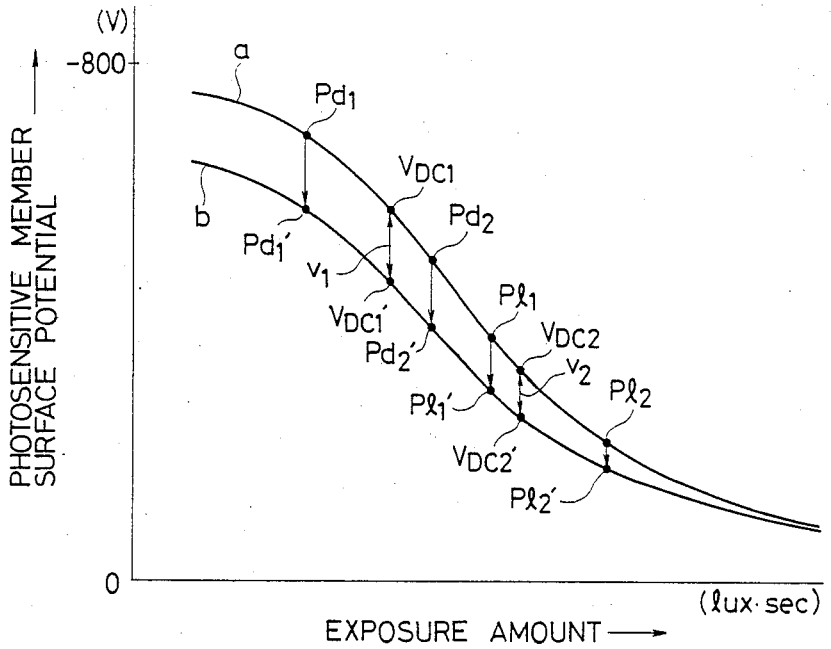
FIG. 14 is a chart showing an E-E characteristic curve.

FIG. 13 shows the change of the developing bias voltage $V_{DC}$ as a function of the remote signal $V_{REM}$. When the relay RY1 is energized to provide a low-level output signal OUT, there is obtained a developing bias voltage $V_{DC}$ of −400V if the remote signal $V_{REM}$ is regulated to 10V by the variable resistor VR. When the relay RY1 is deactivated to provide a high-level output signal OUT, the remote signal $V_{REM}$ is lowered to 9V whereby the developing bias voltage $V_{DC}$ is also lowered to −360V. On the other hand, if the remote signal $V_{REM}$ is regulated to 7.5V when the relay RY1 is energized, the developing bias voltage is equal to −300V. In this state, when the relay RY1 is deactivated, the remote signal $V_{REM}$ is reduced to 6.75V whereby the developing bias voltage is changed to −270V. In this manner the amount of change of the remote signal $V_{REM}$ or of the developing bias voltage varies according to the regulated value of the remote signal $V_{REM}$.

Figure 15:
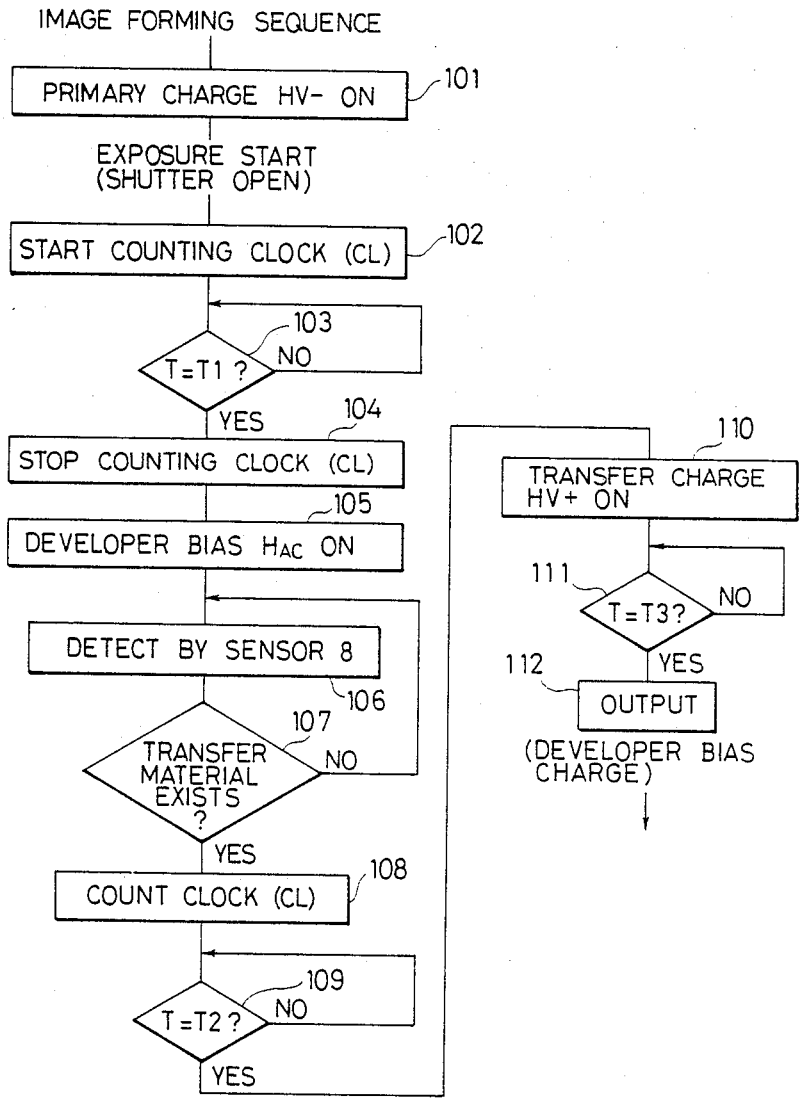
FIG. 15 is a flow chart showing the function of the density regulating device.

The microcomputer 20 functions according to a program stored in the ROM area thereof. FIG. 15 shows a flow chart for executing a program constituting the present invention in the image forming sequence. Said program shows a case of preparing one copy. The function of this embodiment will be explained in the following in relation to said flow chart.

At first, in the course of image forming sequence, primary charging is applied to the photosensitive member 1 maintained in rotation, by supplying a negative high voltage HV− from the driving circuit 2 to the primary charger 2 (step 101). When the imagewise exposure is initiated by the opening of the shutter 10, a step 102 activates a counter of the microcomputer 20 to count clock pulses CL. Upon expiration of a time T1 predetermined in relation to the rotating speed of the photosensitive member 1 and the position of the developing unit 4 (step 103), a step 104 temporarily stops the counting of the clock pulses CL and a signal for applying the biased AC voltage HAC is supplied to the driver circuit 21 (step 105). Since the output signal OUT remains in the low level state, the relay RY1 is energized to obtain a high developing bias voltage $V_{DC}$. Then a step 106 activates the photoelectric sensor 8, and, in response to the detection of a transfer sheet P (step 107), the counting of the clock pulses CL is initiated (step 108). Thereafter, upon expiration of a time T2 predetermined in relation to the feeding speed of the transfer sheet P or the rotating speed of the photosensitive member 1 and the distance between the sensor 8 and the transfer charger 5 (step 109), the driving circuit 21 is given a signal for applying a positive high voltage HV+ to the transfer charger 5 (step 110). Similarly upon expiration of a time T3 predetermined in relation to the rotating speed of the photosensitive member 1 and the distance between the sensor 8 and the developing unit 4 (step 111), the output signal OUT to the determining circuit 123 is shifted to the high level (step 112), whereby the relay RY1 is deactivated to reduce the remote signal $V_{REM}$ and accordingly the developing bias voltage $V_{DC}$. In this manner, the developing bias voltage $V_{DC}$ is lowered when an area of the photosensitive member 1 is brought to the developing unit 4 if it is subjected to transfer charging prior to the primary charging and imagewise exposure for forming the electrostatic latent image.

FIG. 15 shows an E-V characteristic curve, namely the relationship between the exposure and the surface potential after the primary charging with the charger 2 and exposure of the photosensitive member 1, wherein a curve a indicates the E-V characteristic in an area not previously subjected to a transfer charging. In such an area, the surface potential becomes lower than the potential of primary charging (−800V) due to a dark decay even in case of no exposure. A curve b shows the E-V characteristic in an area which is subjected to primary charging and exposure under the same conditions as above, after it is subjected to transfer charging. Let us assume a case of exposing the photosensitive member 1 to an original film of a higher density and another original film of a lower density with an unrepresented same light source. As area of the highest density (dark area) and an area of the lowest density (light area) in the original film of higher density respectively correspond to points $Pd_1$, $Pl_1$ on the characteristic curve a, and an adequate image density is obtained with a developing bias voltage $V_{DC1}$. Similarly the dark and light areas of the original film of lower density respectively correspond to point $Pd_2$, $Pl_2$ on the characteristic curve a, and an adequate image density is obtained with a developing bias voltage $V_{DC2}$. On the characteristic curve b, the dark and light areas of the original film of higher density correspond to points $Pd_1'$, $Pl_1'$, and the dark and light areas of the original film of lower density correspond to points $Pd_2'$, $Pl_2$. Since the image density after development is determined by the difference between the developing bias voltage $V_{DC}$ and the surface potential V of the photosensitive member, developing bias voltages $V_{DC1}'$, $V_{DC2}'$ are required for obtaining the same image densities as above. The difference $v_1$ between the developing bias voltages $V_{DC1}$ and $V_{DC1}'$ in the dark area is larger than the difference $v_2$ between the developing bias voltages $V_{DC2}$ and $V_{DC2}'$. In this manner, for a film of lower density, the potential to the corresponding to the original image is positioned toward the rignt on the characteristic curve and the developing bias voltage $V_{DC}$ becomes lower. The difference between the curve a and b becomes smaller as the surface potential approaches zero. Consequently, the amount of change in the developing bias voltage becomes less as the density of the original film becomes lower.

In the image density regulating device of the present invention, the microcomputer 20 regulates, through the output signal OUT thereof, the remote signal $V_{REM}$ and the amount of change of the developing bias voltage from the driving circuit 21 when an area already subjected to transfer charging is brought to a position facing the developing unit 4. Stated differently, when the characteristic curve is shifted from a corresponding to an area not subjected to the transfer charging to b corresponding to an area already subjected to the transfer charging, the developing bias voltages $V_{DC1}$, $V_{DC2}$ are correspondingly changed to $V_{DC1}'$, $V_{DC2}'$, thus always obtaining an optimum image density. In addition, since the transfer charger 5 is enabled only when the transfer sheet P is present between said charger and the photosensitive member 1, the difference in retentive charge or in the surface potential after charge elimination is relatively small between the area subjected to the transfer charging and the area not subjected to said charging on the photosensitive member 1. Consequently the difference between the curves a and b is relatively small, and the image density after development is made constant even with a small change in the developing bias voltage.

The present invention is not limited to the aforementioned specific voltages but may be suitably modified according to the characteristics and the conditions of use of the photosensitive member. Although negative primary charging is employed in the foregoing embodiments, the present invention is applicable also to an image forming process employing positive primary charging, if the change in the developing bias voltage $V_{DC}$ is inverted. Also the timing of changing the developing bias voltage, determined in the foregoing embodiments by a software process utilizing a counter in the microcomputer, may also be achieved through a hardware process utilizing an encoder such as a photointerrupter provided on the rotating photosensitive member. Also the circuit for determining the developing bias voltage may be any circuit other than those shown in the foregoing embodiment as long as the amount of change is variable according to the determination of the developing bias voltage $V_{DC}$, and may be a circuit for determining the voltage by means of A/D converter and D/A converter for example.

As explained in the foregoing, the electrophotographic apparatus equipped with the image density regulating device of the present invention is capable of providing a copy image of extremely high quality with uniform image density.

Figure 16:
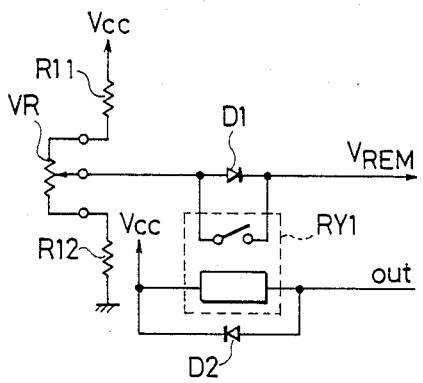
FIG. 16 is a circuit diagram showing the circuit of another density regulating device.

FIG. 16 shows another embodiment of the bias voltage determining circuit 123, in which a fixed voltage Vcc is divided by resistor $R_{11}$, variable resistor VR and resistor $R_{12}$. In this embodiment there are employed diodes D1, D2, and a relay RY1 is controlled by the output signal OUT of the microcomputer 20. When said relay RY1 is energized, the remote signal $V_{REM}$ is released through the contact of said relay and is equal to the divided voltage. On the other hand, when said relay RY1 is deactivated, the remote signal $V_{REM}$ is lower than the divided voltage by the forward voltage drop of the diode D1, which is approximately 0.1V. Said lowering of the remote signal $V_{REM}$ is constant regardless of the degree of adjustment by the variable resistor VR.

Figure 17:
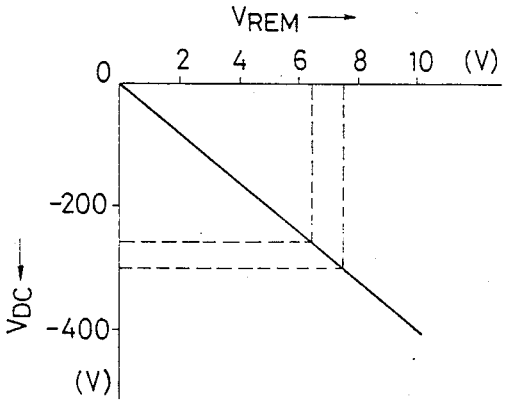
FIG. 17 is a chart showing the change in the developing bias.

FIG. 17 shows the change in the developing bias voltage as a function of the remote signal $V_{REM}$. If the remote signal $V_{REM}$ is regulated to 7.5V by the variable resistor VR when the relay RY1 is energized to provide a low-level output signal OUT, the developing bias voltage is equal to −300V. When the relay RY1 is deactivated to provide a high-level output signal OUT, the remote signal $V_{REM}$ is changed to 6.5V whereby the developing bias voltage $V_{DC}$ is changed to −260V.

Figure 18:
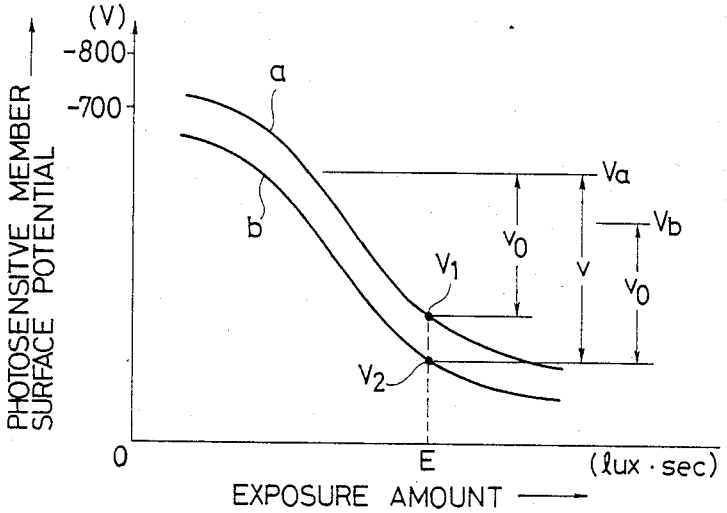
FIG. 18 is a chart showing an E-V characteristic curve.

FIG. 18 shows an E-V characteristic curve, or the relation between the amount of exposure and the surface potential after primary charging and exposure on the photosensitive member 1. A curve a indicates the E-V characteristic of an area, which is subjected to a primary charging of −800V without previous transfer charging. The obtained surface potential is less than −800V because of dark decay even at a zero exposure. An electrostatic latent image with a surface potential V1 obtained with an exposure E is developed with a developing bias voltage Va, the obtained image density is determined by the difference $v_0$ between Va and V1. The image density becomes higher as the difference $v_0$ increases. A curve b which is approximately parallel to the curve a, indicates the E-V characteristic in an area which is subjected to primary charging under the same conditions as above after the previous transfer charging. For the same amount of exposure the surface potential changes from V1 to V2, and the difference v from Va is larger than $v_0$, whereby the density becomes higher. However, the developing bias voltage is changed from Va to Vb by the above-described control when an area previously subjected to transfer charging is brought to the developing unit 4, whereby the potential difference from the surface potential $v_2$ remains unchanged at $v_0$. As a result, the image density after development remains constant. Besides, since the transfer charger 5 is activated only when the transfer sheet P is present between said charger and the photosensitive member 1, the difference in retentive charge or in the potential after charge elimination is small between the area previously subjected to transfer charging and the area not subjected to said charging. Consequently, the difference between the curves a and b is relatively small, and the image density after development can be maintained constant with a small change in the developing bias voltage.

In the following, there will be explained an electrophotographic apparatus embodying the present invention, capable of preventing, in the P-P mode, the toner deposition outside the image area by blank exposure.

Figure 19:
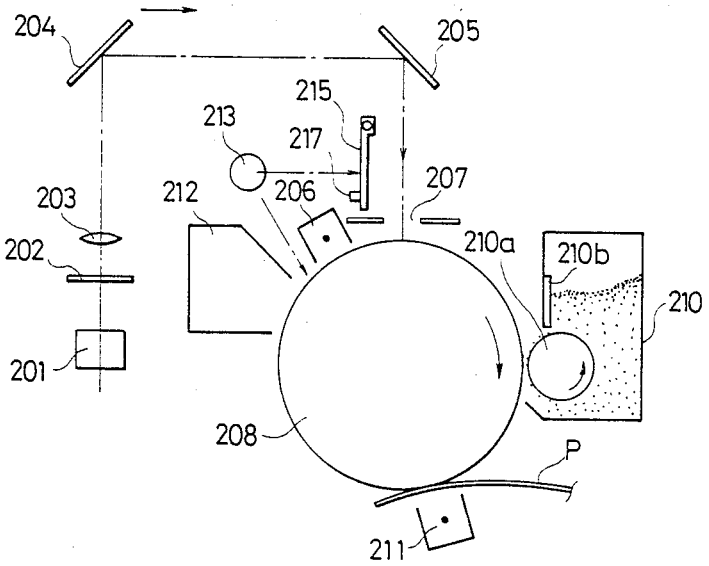
FIGS. 19 and 20 are schematic views showing another embodiment of the electrophotographic apparatus of the present invention.

FIG. 19 schematically shows a printer for preparing a hard copy from an original image on a microfilm, wherein the original image on a microfilm 302 is illuminated by an illuminating unit 201 and is projected, through a projecting lens 203 and mutually orthogonal mirrors 204, 205 moving in a direction indicated by an arrow, onto a rotating photosensitive drum 208 which is subjected to primary charging by a charger 206 in the course of said rotation, thereby forming an electrostatic latent image on said photosensitive member 208. Said latent image is developed by charged toner supplied from a developing unit 210. A developing sleeve **210*a* and a blade 210*b* of the developing unit 210 receive a bias voltage composed of an AC voltage and a DC voltage. The developed toner image is transferred by a transfer charger 211 onto a transfer sheet P and is fixed in an unrepresented fixing unit to obtain a hard copy. The toner remaining on the photosensitive member 208 is removed by a cleaner 212, and a retentive charge is dissipated by the light from a light source 213**.

Figure 20:
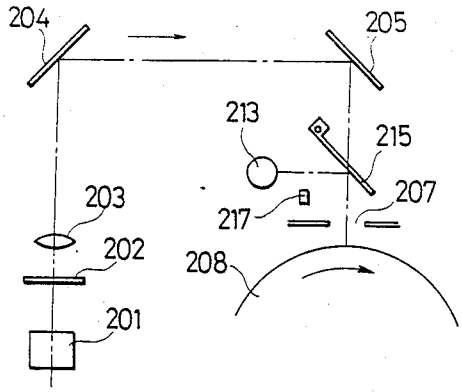

In case of obtaining a positive copy from a positive original image on the microfilm, the unexposed non-image area on the photosensitive member 208 is developed black because of presence of electrostatic charge, thus forming an unpleasant black frame around the exposed image area, and causing a waste of the toner. In order to avoid such unnecessary toner deposition, uniform illumination, called blank exposure, is conventionally given to the non-image area. In the apparatus shown in FIG. 19, a rotary shutter 215 constitutes a mirror on a face thereof at the photosensitive member 208. When it opens a first imaging path for imagewise exposure, it intercepts the light from the light source 213 by closing a second light path, and, when it is inserted in the first light path, it illuminates the photosensitive member 208 with the light from the light source 213 as shown in FIG. 20.

Figure 21:
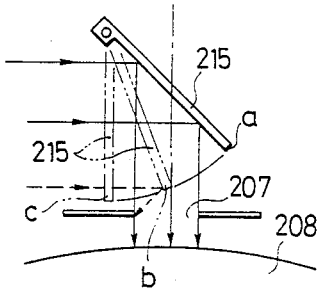
FIG. 21 is a schematic view showing the function of an essential part thereof.

However, there is a change in the amount of exposure to the photosensitive member 208 in the course of shift from the blank exposure to the image exposure or in the inverse course of shift by the rotation of the shutter 215. Referring to FIG. 21, the blank exposure alone reaches the photosensitive member at a position a where the shutter 215 is completely closed, but gradually becomes weaker with the opening of said shutter and becomes almost zero at a position b where the shutter 215 is not yet completely open. The image exposure gradually increases in the inverse direction.

Figure 22:
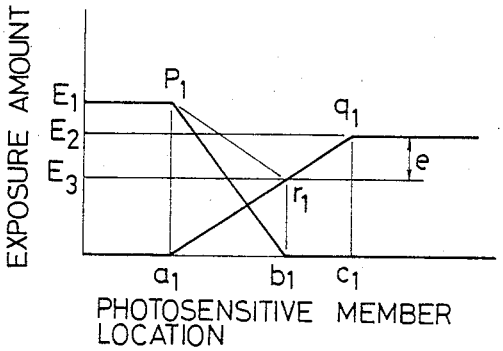
FIGS. 22 and 23 are charts showing the change in exposure according to the position on the photosensitive member.
Figure 23:
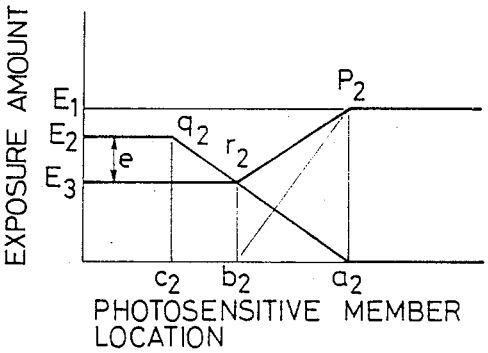

The above-mentioned relationship is shown in FIG. 22, in which the amount of exposure in ordinate is shown as a function of position of the photosensitive member in abscissa. Points $a_1$, $b_1$ and $c_1$ respectively indicate the amounts of exposure to the photosensitive member 208 when the shutter 215 is at a closed position a closest to a slit 207, at an intermediate position b, and at an open position c. E1 and E2 respectively indicate the maximum blank exposure and the maximum image exposure. Along the opening movement of the shutter 215, the blank exposure decreases from E1, approximately along a line between $p_1$ and $b_1$, while the image exposure increases approximately along a line between $a_1$ and $q_1$ to reach the maximum value E2. Consequently, the change in the amount of exposure to the photosensitive member in the course of opening movement of the shutter 215 is represented by lines passing the points $p_1$, $r_1$ and $q_1$. Consequently, in the course of such opening movement of the shutter 215, the amount of exposure drops by an amount e from the maximum image exposure E2, wherein e is the difference between E2 and a minimum exposure E3 at the point r1. In the course of closing movement of the shutter 215 there also appears a decrease e in the exposure as shown in FIG. 23, in which the points $a_2$, $b_2$, $c_2$, $p_2$, $q_2$ and $r_2$ respectively correspond to the points $a_1$, $b_1$, $c_1$, $p_1$, $q_1$ and $r_1$ in FIG. 22.

Such phenomenon generates a background smudge or a black streak in a white area of the image at the initial or last part of the image exposure, thus deteriorating the image quality and causing a waste of the toner. In this manner the significance of the blank exposure is considerably reduced.

The unnecessary toner deposition can be prevented by elevating the DC component $V_{DC2}$ of the developing bias voltage, even without the blank exposure (E1=0). In this method, however, the developing bias voltage has to be switched at an exact timing, since there may result a spark discharge across the narrow gap between the photosensitive member 208 and the developing sleeve 210 at a peak of the AC component of the developing bias voltage (point Vh in FIG. 25), if the DC component is made higher when an exposed light area of zero surface potential in the photosensitive member 208 is brought to a position facing the developing sleeve 210*a*, because of the maximum potential difference $v_{MAX}$ in such situation. Such spark discharge, once generated, will create a permanent pinhole, an unrecoverable damage in the photosensitive member 208.

Experimentally, such spark discharge is generated for a gap of 0.24 mm between the photosensitive member 208 and the developing sleeve 210*a*, if the difference $v_{MAX}$ between the potential Vh where the AC component reaches a peak and the surface potential of said photosensitive member 208 reaches ca. 1500V. Consequently, if the peak-to-zero voltage of the AC component is equal to 700V, the DC component can be made as large as −800V. In order to avoid toner deposition in the non-image area without the blank exposure (E1=0), the DC component has to be increased approximately to −900V which is larger than −100V than the surface potential −800V in the dark area in the image area. Such large increase in the DC component will bring the difference between the potential at the peak of the AC component and the potential in the light area of the image area to 1600V, thus reaching the spark discharge voltage between the photosensitive member 208 and the developing sleeve 210*a*. Consequently, the developing bias voltage has to be switched at a timing before the image area reaches a position facing the developing sleeve 210*a*, namely before the complete opening of the shutter 215 at the start of image exposure and when a position corresponding to the start of shutter closing movement reaches the developing position at the end of image exposure. However the shutter 215 is often actuated by a solenoid, and the timing of opening and closing is undetermined because of fluctuation in the performance of the solenoid. Because of such unstable timing, there may be resulted in a spark discharge due to an elevated DC component while the image area is facing the developing sleeve.

An object of the present invention is to provide an electrophotographic apparatus which is free from such drawbacks in the conventional art, is capable of providing images of a high quality, reducing the consumption of toner and avoiding the damage in the photosensitive member by the spark discharge.

The above-mentioned object can be achieved according to the present invention by an electrophotographic apparatus in which a charged photosensitive member is subjected to image exposure and is then developed with developing means under a bias voltage, wherein said bias voltage is regulated between a state in which an area of the photosensitive member not subjected to image exposure reaches said developing means after light exposure, and another state in which an area subjected to image exposure reaches the developing means.

Referring to FIG. 19, there is provided a switch 217 to be actuated at the fully open position c, shown in FIG. 21, of a shutter 215.

Figure 24:
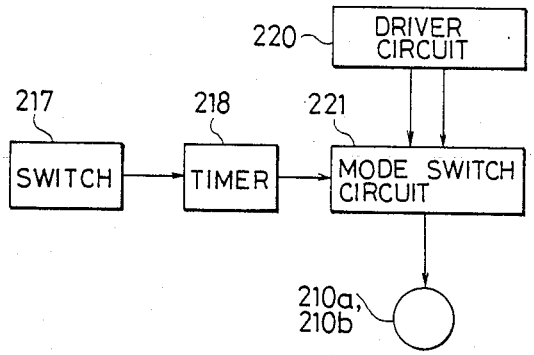
FIG. 24 is a block diagram of a control circuit of another embodiment of the electrophotographic apparatus of the present invention.

FIG. 19 shows the principal parts of the apparatus embodying the present invention, and FIG. 24 is a block diagram of a control circuit to be employed in said apparatus, wherein shown are a timer 218, a driving circuit 220 for generating the developing bias voltage, and a switching circuit 221 for the developing bias voltage.

The timer 218 initiates time counting in response to a signal from the switch 217 actuated when the shutter 215 is fully opened, continues counting in synchronization with the rotating speed of the photosensitive member 208 to measure the time from the exposure to the position facing the developing sleeve 210*a* and releases a corresponding signal to the switching circuit 221. The driving circuit 220 for generating the developing bias voltage, supplies the switching circuit 221 with a biased AC voltage containing a DC component $V_{DC1}$ and another biased AC voltage containing a negatively larger DC component $V_{DC2}$. While the area subjected to the image exposure alone is in front of the developing sleeve 210*a*, the switching circuit 221 releases the developbias voltage including the DC component $V_{DC1}$. When the area subjected to both blank exposure and image exposure in the course of rotation of the shutter or the area subjected to blank exposure alone is brought to the developing sleeve 210*a*, the switching circuit 221 shifts the output to the developing bias voltage including the DC component $V_{DC2}$ in response to a signal from the timer 218. A slight fluctuation in the timing of said voltage switching is not critical since the exposure shows gradual change in the vicinity of boundaries of said areas.

Figures 25A, 25B:
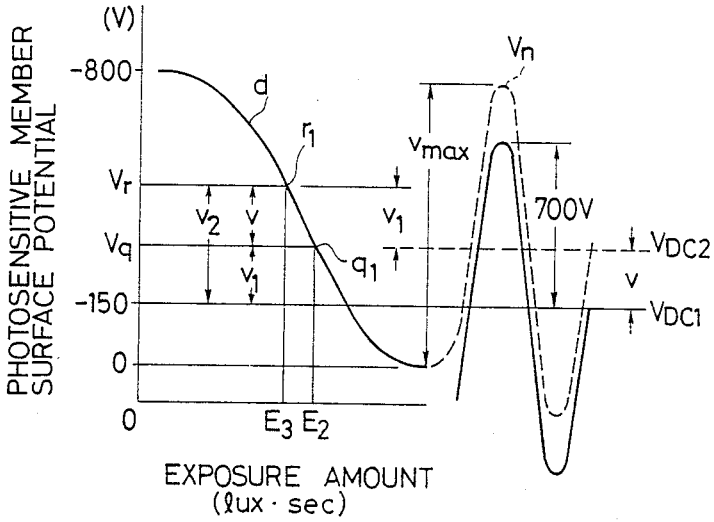
FIG. 25*a* is a wave form chart showing the biased AC voltage.
FIG. 25*b* is a chart showing the relationship between the exposure and the surface potential of the photosensitive member.

Now reference is made to FIG. 25*a* for more ( detailed explanation of the biased AC voltages containing the DC component $V_{DC1}$ or $V_{DC2}$.

FIG. 25*b* shows an E-V characteristic curve d indicating the relationship between the surface potential (in ordinate in volts) and the amount of exposure (in abscissa in lux.second) on the photosensitive member subjected to a primary charging to −800V. FIGS. 25*a* and 25*b* are shown in the same scale of voltage. The image density becomes higher as the difference between the DC component of the developing bias voltage and the surface potential of the photosensitive member becomes larger. The DC component $V_{DC1}$ is so determined as to obtain an adequate image density at an exposure E2. The exposure E2 and the minimum exposure E3 in the course of shutter opening or closing movement respectively correspond to points $q_1$, $r_1$ on the E-V characteristic curve d shown in FIGS. 22 and 23. The corresponding potentials are Vq, Vr which are respectively different from $V_{DC1}$ by $v_1$, $v_2$. If the DC component $V_{DC1}$, shown by a full line, is shifted by v which is the difference between $v_1$ and $v_2$ to $V_{DC2}$ shown by a broken line, the potential difference between Cr and $V_{DC2}$ is equal to $v_1$. Consequently, the same image density is obtained on the positions $q_1$, $r_1$ on the photosensitive member, and the background smudge can be prevented since the non-image area at least receives an exposure equal to E3.

The DC component $V_{DC1}$ of the developing bias voltage for obtaining an adequate image density in the image area is equal to −150V, and the DC component $V_{DC2}$ in the non-image area is −450V which is larger by −300V than said $V_{DC1}$.

As explained in the foregoing, the electrophotographic apparatus of the present invention is capable of providing an image of high quality without background smudge or black streak, saving the consumption of toner and preventing damage in the photosensitive member.

It is also possible to employ other means for forming a latent image on the photosensitive member such as a laser beam exposure device, an LED array or stilus electrodes. In addition the image bearing member is not limited to a photosensitive one but can be a dielectric one.

Also, the method of image development is not limited to the process described above but is subject to various modifications.

What is claimed is:

1. An electrophotographic apparatus comprising:
- means for forming an electrostatic latent image on a photosensitive member by image exposure thereonto;
- development means for developing said latent image on said photosensitive member with toners;
- developing bias voltage generating means for applying a bias voltage to said development means;
- exposing means for exposing a non-image-exposed area on said photosensitive member to substantially uniform light;
- detecting means for detecting an image-exposed area and the uniformly-exposed area on said photosensitive member; and
- means for controlling said bias voltage generating means based on an output of said detecting means, said controlling means controlling said bias voltage generating means so that the bias voltages are different from each other when only an image-area on said photosensitive member is exposed to said development means, when only a uniformly-exposed area on said photosensitive member is exposed to said development means, and when both an image-area and a uniformly-exposed area are exposed to said development means by said exposure means.

2. An electrophotographic apparatus according to claim 1, further comprising a shutter capable of opening or closing a first optical path for image exposure to the photosensitive member and opening or closing a second optical path for uniform illumination of the photosensitive member, said shutter being adapted to close or open said second optical path respectively when it opens or closes said first optical path.

3. An electrophotographic apparatus switchable between a mode for forming a positive image from a negative original and a mode for forming a positive image from a positive original, comprising:
- means or forming an electrostatic latent image on an image bearing member;
- first development means for developing said latent image with toners charged in the same polarity as said image bearing member is charged;
- second development means for developing said latent image with toners charged in the opposite polarity to said charged polarity of said image bearing member;
- developing bias voltage generating means for applying a bias voltage of a determined polarity to said first and second development means;
- operating means for setting a density of the image on said image bearing member;
- first control means for controlling said developing bias voltage generating means such that said bias voltage decreases when the image density is set to become lower by said operating means;
- second control means for controlling said developing bias voltage generating means such that said bias voltage increases when the image density is set to become lower by said operating means; and
- selection means for selecting one of said first and second control means in response to said switching of mode to change said bias voltage applied to said development means by the selected control means.

4. An electrophotographic apparatus according to claim 3, wherein said bias voltages of said first and second control means, corresponding to the densities set by said operating member, are stored in a ROM.

5. An electrophotographic apparatus according to claim 3, wherein respective control regions of the bias voltages of said first and second control means, corresponding to respective density regions capable of being set by said operating means, are different from each other.

6. An electrophotographic apparatus according to claim 3, wherein either of said first and second development means may be detachably arranged at a common development position, and the selected one of said first and second development means is located at said development position.

7. An image forming apparatus in which an original image is exposed onto a photosensitive member to form an electrostatic latent image thereon, and said lateent image is developed to be transferred onto a recording medium, comprising:
- development means for developing said latent image with toners selected from those charged in the same polarity as said photosensitive member is charged and those charged in the opposite polarity to the charged polarity of the photosensitive member;
- developing bias voltage source means for applying a bias voltage of a determined polarity to said development means;
- indication means for indicating a density of image to be formed on the recording medium;

first control means for controlling said developing bias voltage source such that said bias voltage decreases when the image density is indicated to become lower by said indication means;

second control means for controlling said developing vias voltage source such that said bias voltage increases when the image density is indicated to become lower by said indication means; and selection means for selecting one of said first and second control means in accordance with the polarity of toners for developing the latent image on the photosensitive member to charge the bias voltage applied to said development means by the selected control means.

8. An image forming apparatus according to claim 7, wherein said development means comprises first development means using the toners charged in the same polarity as the photosensitive member is charged, and second development means using the toners charged in the opposite polarity to the charged polarity of the photosensitive member, said first and second development means being selectively operated upon development.

9. An image forming apparatus according to claim 8, further comprising switching means for switching a mode of the apparatus between a mode forming a positive image from a negative original image and a mode for forming a positive image from a positive original image, said first and second development means selectively operating in response to the switching of said switching means.

10. An image forming apparatus according to claim 7, wherein said indication means comprise a scale for showing the image density and an indicator for indicating a degree of the image density on said scale.

11. An image forming apparatus according to claim 7, wherein respective regions of bias voltages controllable by said first and second control means, corresponding to respective regions of densities indicated by said indication means, are different from each other.

12. An image forming apparatus according to claim 7, wherein one of said first and second development means is selectively positioned at a developement station.

13. An image forming apparatus comprising:

means for forming an electrostatic latent image with a first polarity on an image carrier;

first developing means for depositing a first developer charged with a second polarity, different from the first polarity, onto the electrostatic latent image for performing direct developing;

second developing means for depositing a second developer charged with the first polarity onto the electrostatic latent image for performing reverse developing;

mode signal generating means for selectively generating either of a first mode signal for forming a positive image from a positive original and a second mode signal for forming a positive image from a negative original;

first bias means for applying a first bias voltage to said first developing means for performing direct developing by said first developing means;

second bias means for applying a second bias voltage of the same polarity as that of the first bias voltage to said second developing means for performing reverse developing by said second developing means;

means for selectively actuating either of said first and second bias means in accordance with the mode signals generated by said mode signal generating means;

setting means for setting a density of the image;

bias control means for controlling bias voltages of said first and second bias means in accordance with the density set by said setting means; and transfer means for transferring onto a sheet the developed image which is formed on said image carrier by one of said first and second developing means, said transfer means providing a charge in the first polarity or in the second polarity in accordance with the mode signals.

14. An image forming apparatus according to claim 13, wherein an adjustable range of the bias voltage of said first bias means is different from that of said second bias means.

15. An image forming apparatus according to claim 14, wherein the adjustable range of the bias voltage of said first bias means is narrower than that of said second bias means.

16. An image forming apparatus according to claim 13, wherein said setting means includes a common operating member for adjusting the bias voltages of said first and second bias means.

17. An image forming apapratus according to claim 16, wherein when the density is changed by said common operation member, one of the first and second bias voltages of said first and second bias means increases, and the other decreases.

18. An apparatus for reading and printing microfilm images comprising:

means for exposing an original image of the microfilm onto a photoreceptor having a charged surface with a first polarity to form an electrostatic image on the charged surface corresponding to the original image;

first developing means for depositing a first developer charged with a second polarity, different from the first polarity, onto the electrostatic latent image for performing direct developing;

second developing means for depositing a second developer charged with the first polarity onto the electrostatic latent image for performing reverse developing;

mode signal generating means for selectively generating either of a first mode signal for forming a positive image from a positive microfilm and a second mode signal for forming a positive image from a negative microfilm;

first bias means for applying a first bias voltage to said first developing means for performing direct developing by said first developing means;

second bias means for applying a second bias voltage of the same polarity as that of said first bias voltage to said second developing means for performing reverse developing by said second developing means;

means for selectively actuating either of said first and second bias means in accordance with the mode signals generated by said mode signal generating means;

setting means for setting a density of the image;

bias control means for controlling bias voltages of said first and second bias means in accordance with the density set by said setting means; and transfer means for transferring onto a sheet the developed image which is formed on said photoreceptor by one of said first and second developing means, said transfer means providing a charge in the first polarity or in the second polarity in accordance with the mode signals.

* * * * *

UNITED STATES PATENT AND TRADEMARK OFFICE

CERTIFICATE OF CORRECTION

PATENT NO. : 4,789,878

DATED : December 6, 1988

INVENTOR(S) : MAKOTO ENDO ET AL.

It is certified that error appears in the above-identified patent and that said Letters Patent is hereby corrected as shown below:

On the title page

AT [30] FOREIGN APPLICATION PRIORITY DATA

Lines 2-6, "March 4, 1984" all four (4) occurrences should read --April 3, 1984--.

AT [57] ABSTRACT

Line 2, "A" should read --An--.

COLUMN 3

Line 24, "a" should read --an--.
Line 45, "E-E" should read --E-V--.

COLUMN 4

Line 64, "variable," should read --variable--.

COLUMN 5

Line 3, "hig" should read --high--.
Line 65, "$V_{0+v1.}$" should read --$v_0+v_1$.--.

COLUMN 8

Line 22, "$Pd_{2\cdot}$, $Pl_2$." should read --$Pd_{2\cdot}$, $Pl_{2\cdot}$--.
Line 33, "rignt" should read --right--.

COLUMN 12

Line 61, "( de-" should read --de- --.

UNITED STATES PATENT AND TRADEMARK OFFICE

CERTIFICATE OF CORRECTION

PATENT NO. : 4,789,878

DATED : December 6, 1988

INVENTOR(S) : MAKOTO ENDO ET AL.

It is certified that error appears in the above-identified patent and that said Letters Patent is hereby corrected as shown below:

COLUMN 14

Line 11, "or" should read --for--.
Line 55, "lateent" should read --latent--.

COLUMN 15

Line 6, "vias" should read --bias--.

COLUMN 16

Line 25, "operation" should read --operating--.

Signed and Sealed this

Twenty-seventh Day of March, 1990

*Attest:*

JEFFREY M. SAMUELS

*Attesting Officer*

*Acting Commissioner of Patents and Trademarks*